United States Patent [19]

Buchacz

[11] Patent Number: 5,052,753

[45] Date of Patent: Oct. 1, 1991

[54] ADJUSTABLE SITTING DEVICE

[76] Inventor: Jurek Buchacz, "Lovli", N-2360 Ringsaker, Norway

[21] Appl. No.: 474,311

[22] Filed: Feb. 2, 1990

Related U.S. Application Data

[63] Continuation of Ser. No. 251,112, Sep. 29, 1988, abandoned, which is a continuation-in-part of Ser. No. 143,166, Jan. 1, 1988, abandoned.

[30] Foreign Application Priority Data

May 9, 1986 [NO] Norway ..... 861865

[51] Int. Cl.[5] ..... A47C 1/024

[52] U.S. Cl. ..... 297/361; 297/306; 297/355

[58] Field of Search ..... 297/300, 304, 306, 313, 297/337, 354, 355, 361

[56] References Cited

U.S. PATENT DOCUMENTS

| | | | |
|---|---|---|---|
| 3,284,135 | 11/1966 | Hiramatsu | 297/361 |
| 4,372,608 | 2/1983 | Hotta | 297/361 |
| 4,386,805 | 6/1983 | Boisset | 297/355 X |
| 4,408,800 | 10/1983 | Knapp | 297/300 X |

FOREIGN PATENT DOCUMENTS

| | | | |
|---|---|---|---|
| 2735522 | 2/1979 | Fed. Rep. of Germany | 297/354 |
| 66397 | 12/1912 | Switzerland | 297/68 |
| 913918 | 12/1962 | United Kingdom | 297/354 |

*Primary Examiner*—Peter R. Brown

*Attorney, Agent, or Firm*—Browdy and Neimark

[57] ABSTRACT

An adjustable sitting device has a mechanism to alter the mutual angle between the seat and the back rest, the seat and/or back rest being turnable about a first imaginary axis which is essentially coincident with a second imaginary pivoting axis of the hips of the chair user, wherein the back rest comprises frame members extending downward from the back rest and into a respective curved portion. The seat comprises at least a pair of runners attached to a seat frame, and a support is located underneath the seat frame, the seat frame having an opening therein to provide access from above to the support with the support being interconnected from below to a chair subframe, the frame members slidably engaging a set of slide shoes located at the rear of the seat frame, and the runners slidably engaging sets of slide shoes located on the support. A control mechanism extends between a front region of at least one of the frame members and a front region of the seat frame to control and selectively set the distance between the regions.

4 Claims, 7 Drawing Sheets

(PRIOR ART)

FIG. 10
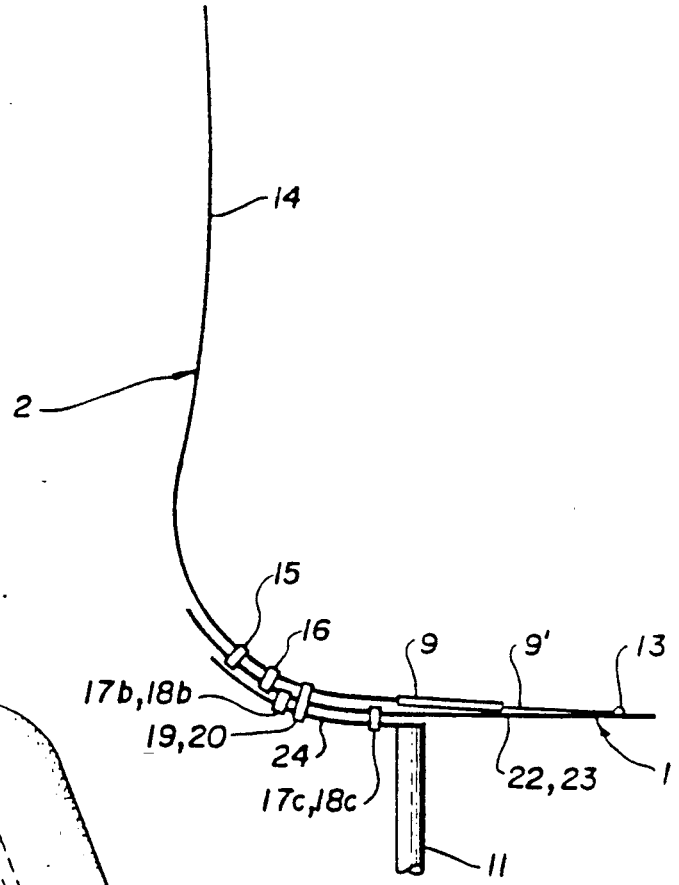
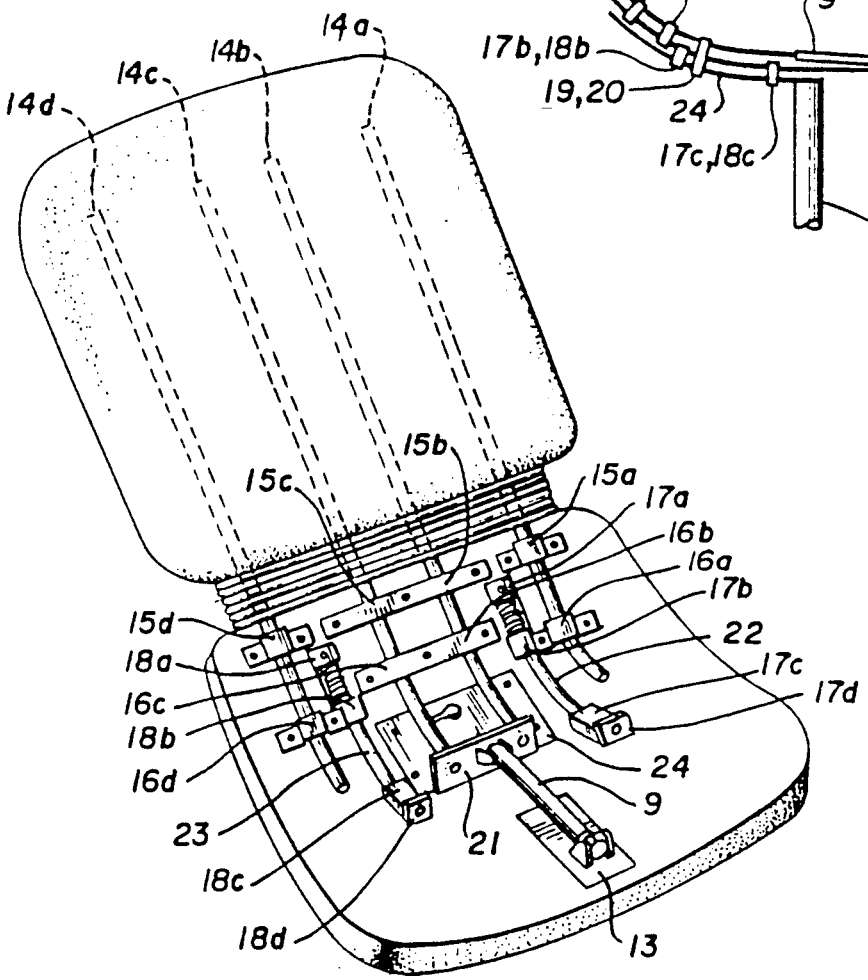
FIG. 11

FIG. 12
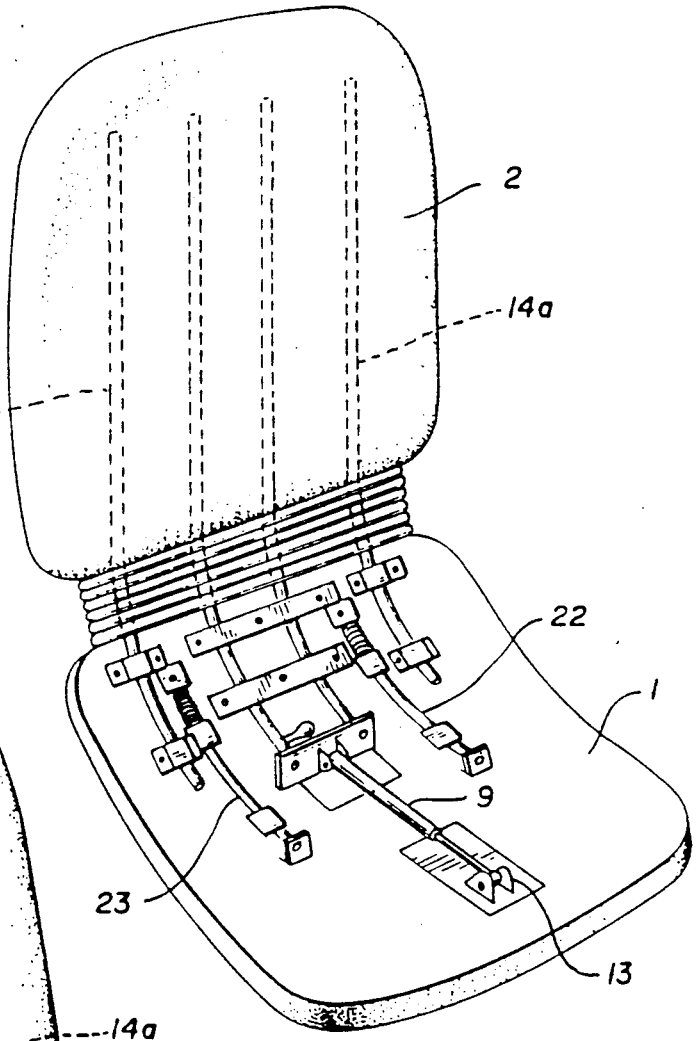
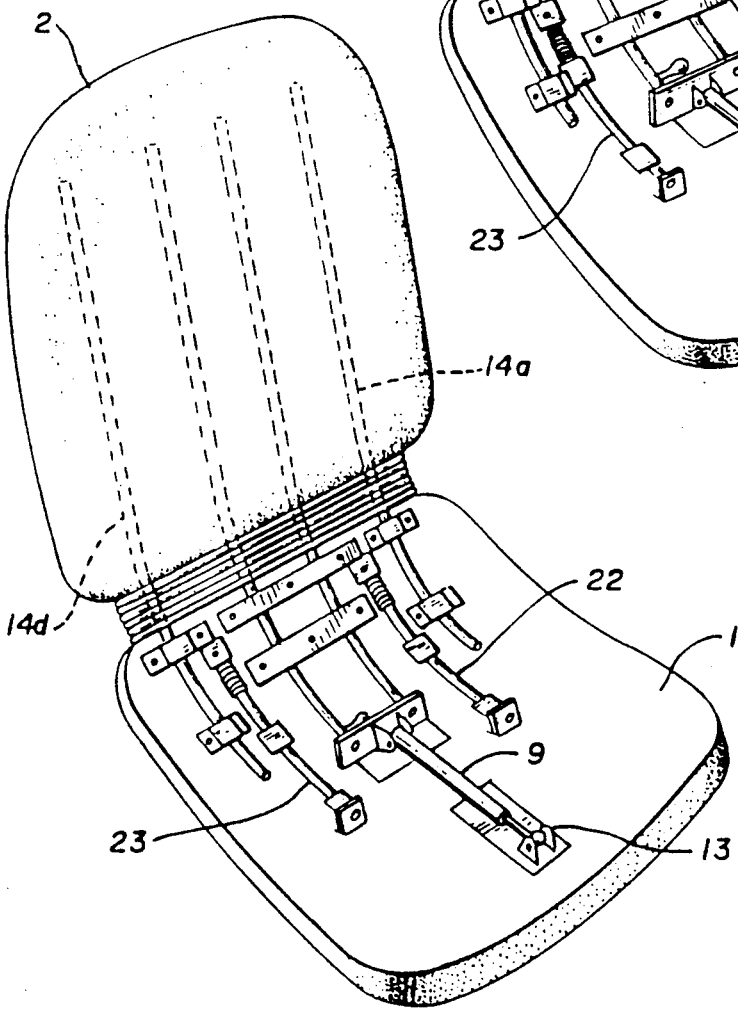
FIG. 13

ADJUSTABLE SITTING DEVICE

This application is a continuation of application Ser. No. 07/251/112 filed Sept. 29, 1988, now abandoned, which is a continuation-in-part of Ser. No. 07/143/166, filed Jan. 1, 1988, now abandoned.

BACKGROUND OF THE INVENTION

1. Field of the Invention

The present invention relates to an adjustable sitting device, e.g. a chair, with the angle enclosed by the seat and the back rest being adjustable, if desired, with simultaneous adjustment of the level of said seat and back rest.

2. The Prior Art

Adjustment of the seat angle alone is of special importance for working chairs, and is necessary in situations requiring adjustment of the sitting level. Separate adjustment of the seat angle is common between an original position with the seat being inclined approximately 5° forward and to a maximum of 15° backward, i.e. a range of adjustment of approximately 20°. A forward adjustment of the seat angle is also advantageous when the user is to rise from a chair, especially a chair for patients and users with impaired motory power. In this case it is, however, a condition that the sitting level may be adjusted while the user is seated on the chair.

Separate adjustment of the seat angle from 5° forward and backward has no other function than that of reducing the angle of the user's body between the upper part of the body and the thighs.

The knee joint is the most important point of reference in case of angular adjustments. Provided that the chair is adapted for a special person the ratio between sitting level and sitting angle is commonly fixed. Adjustment of the seat angle should be stepless in the entire range of angles, and it should be possible to lock the chair at a desired angle. In connection with the above-mentioned, however, only adjustment of the seat was considered without taking the back rest into consideration.

In conformity with angular adjustment of the chair most of the weight of the body will act on the rear side of the turning point, but as opposed to an increased load in case of backward adjustment, the load will be reduced in case of forward adjustment. Balancing by spring suspended weights or the like will commonly be necessary.

Separate adjustment of the back rest angle is common in relation to a firmly fixed seat. Similar to adjustment of a seat with a back rest a comfortable position of rest will be achieved with approximately 30° of backward tilting of the back rest. As opposed to adjustment of the seat with its back rest the angle of the body between the upper part of the body and the thighs will, additionally become more open.

Due to the fact that adjustment of the back rest occurs in relation to the seat the turning point should, ideally, be positioned in conformity with the hip joint of the user. The range of angular adjustment of the back rest should be from approximately 15° backwards to at maximum a reclining position, if desired. An open angle of the body will have a positive effect on the breathing function and the circulation in the stomach region. A main disadvantage is, however, that the weight vector from the upper part of the body will cause the user of the chair to slide out of the seat, since the seat angle is not changed. If the turning point is, thus, not in conformity with the hip joint, displacement between the upper part of the body and the back rest will occur, however, dependent on the angle of the back. Due to this fact a possible neck rest and a support for the lumbar regions will change their positions relative to the upper part of the user's body.

By simultaneous adjustment of the seat and the back rest, so called sync adjustment there will be an established relationship between said portions. Commonly, the back rest will then move a double distance as compared with the seat. The great advantage of sync adjustment is that it maintains the main advantages of the above-mentioned methods of adjustment and eliminates the main disadvantages of them. Thus, it is possible to achieve a comfortable position of rest, slightly reclining backwards with an open angle of the body, and at the same time an inclined seat will prevent the user from sliding out of the chair. By individual adjustment a so-called asynchronous movement is achieved requiring two separate mechanisms with associated control members for the seat and the back rest, respectively. The main disadvantages of most existing chair arrangements is, thus, lack of cooperation between the chair and the adjusting mechanism and the fact that the mechanical structures are relatively conspicuous. Furthermore, considerations of anatomy are often neglected, and the operation of the adjustment members of the chair is cumbersome.

In connection with said adjustments, the adjustment of the seat level should also be mentioned. Often the back rest is adjusted at the same time as the seat. The level of the chair is adjusted to ensure maximum surface contact between the seat and the body of the user. A correct sitting position is achieved when the angle of the body equals the angle between the seat and the back rest of the chair, and the user's feet find good support on the floor, commonly at an angle equal to the angle of the back. The point of reference for adjustment of the level will, thus, be the knee joint.

Varying sitting levels are often required, depending on the working conditions or special requirements of the user. Any change of the seat level should always require adaption of the seat angle. The basic adjustment of the seat level must cover a range that is determined by the difference between the calf length of a big man and that of a small woman. Relevant data are found in antropometric tables The range of adjustment for sitting level from the basic adjustment will also depend on the function of the chair and, form time to time, there is need for being able to adjust up to a half standing position.

SUMMARY OF THE INVENTION

It is, thus, an object of the present invention to solve the problems which arise with known kinds of sitting devices, and according to the invention the seat and/or the back rest is/are turnable about an axis which approximately coincides with an imaginary axis through the hip joint of the user.

The angular adjustment between the seat and the back rest, thus, occurring along a circular path with the turning center located at the imaginary axis through the hip joints of the user, the advantage is achieved that any mutual displacement between the external faces of the body and the sitting device is eliminated all over the range of adjustment.

Even though the present invention is, for the sake of simplicity, called a chair above, the invention obviously also concerns other kinds of sitting devices.

BRIEF DESCRIPTION OF THE DRAWINGS

Further characterizing features of the invention will appear from the following claims as well as from the disclosure below with reference to the drawings, in which:

FIG. 10 is a schematic representation of the chair in FIG. 9; and

FIGS. 11, 12 and 13 illustrate the chair of FIG. 9 in a slightly modified version and in three different situations of the seat and back rest combination.

DETAILED DESCRIPTION OF THE PREFERRED EMBODIMENT

Figure 1:
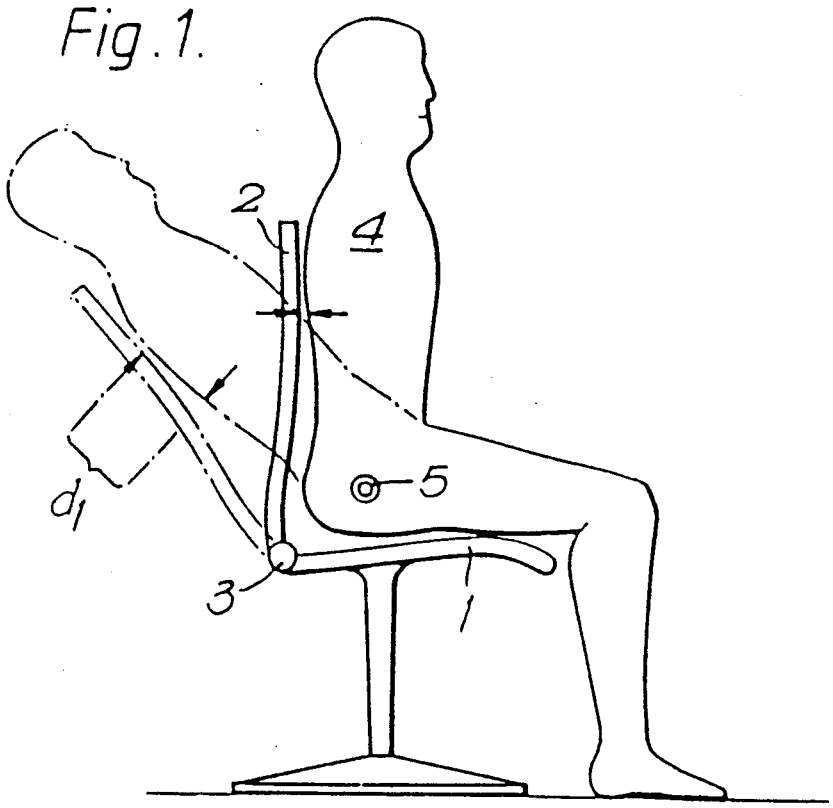
FIGS. 1 and 2 illustrate chairs produced according to known technology.

It is commonly known to adjust the angle between the seat 1 and the back rest 2, and there is a number of mechanical approaches which may mainly be divided into two groups, one of which, shown in FIG. 1, has an adjustment axis provided with more consideration for the chair structure than for anatomy. The common turning axis 3 between seat and back rest is located at a relatively large distance from the hip joints 5 of the user of the chair. When back rest 2 is tilted backwards, this will cause a displacement $d_1$ of the point of contact between the back rest and the back of the user 4, as will appear from FIG. 1.

With another known approach having the turning point of the back rest and, possibly, the seat located beneath the seat surface and, thus, as a considerable distance from said hip joints 5, said bearing point 6 will cause the point of contact between back rest 2 and the back of user 4 to be displaced over a distance $d_2$, when the back rest is tilted backwards. In both cases the user will slide forwards on the chair, as shown, due to an unfortunate choice of turning point between seat and back rest.

Figure 2:
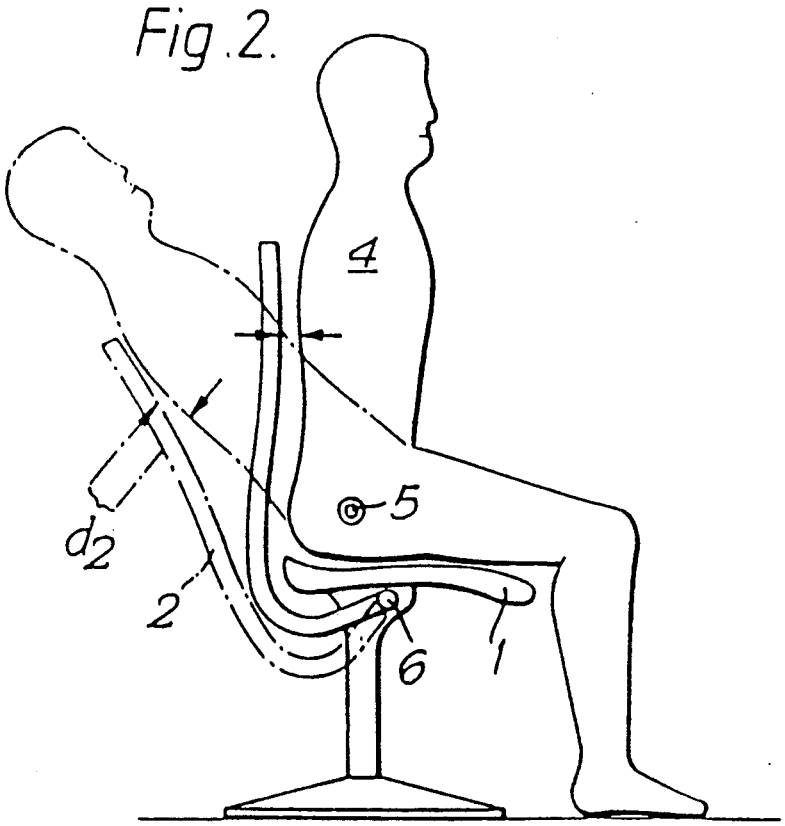
(PRIOR ART) Fig. 2.

In FIG. 2 axis 6 is, however, located in such a manner that the disproportion between the movements of the chair and of the user's body is slightly reduced as compared to the conditions shown in FIG. 1.

Figure 3:
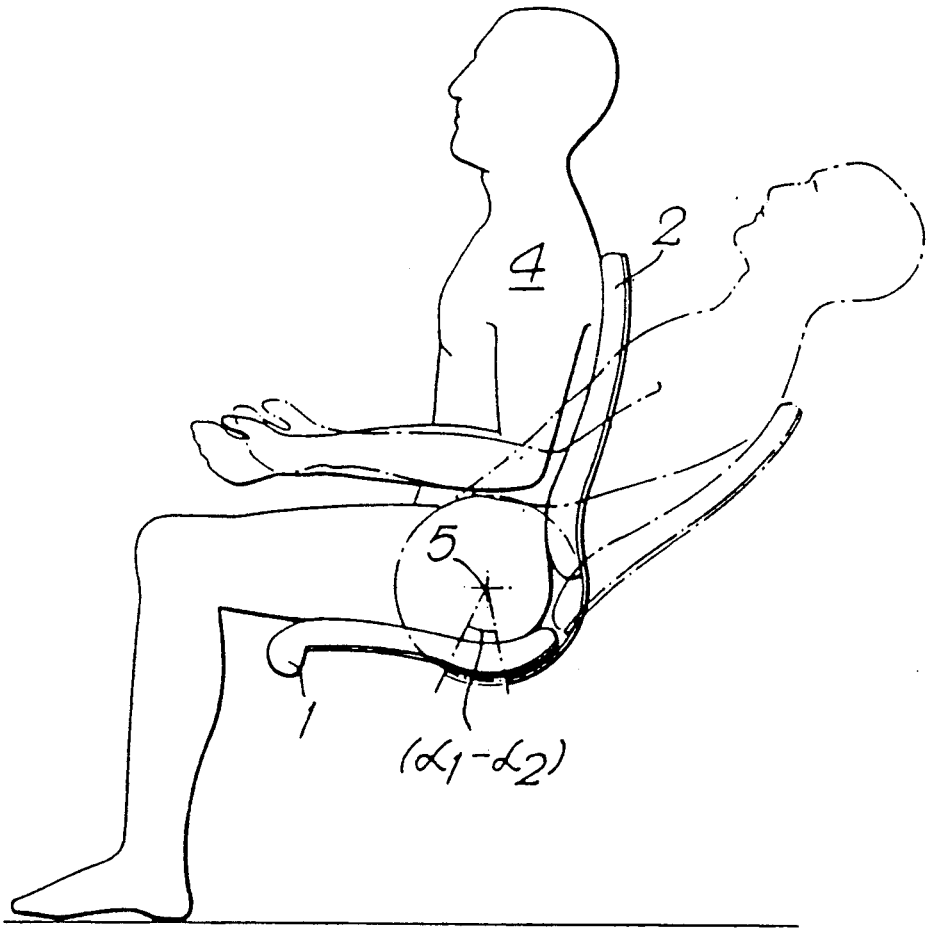
FIG. 3 illustrates a chair according to the invention.

FIG. 3 shows how the adjustment of angles between seat 1 and back rest 2 may occur by making the seat and the back rest move along a circular path the imaginary turning point of which is located to coincide with an imaginary axis through the hip joints 5 of the user. As will appear from FIG. 4 as well, there will be no resulting sliding movement forwards on the chair and, thus, no displacement between the point of contact of the back rest with the back of the user 4. Furthermore, it will be clear that the adjusting mechanism of the chair need not be thicker than the supporting back rest/seat shell, since said mechanism may be integrated in the supporting shell of the chair. With the approach shown in FIGS. 3, 4, and 5 the load on the adjusting mechanism may be reduced, as compared to the existing approaches. Mechanisms for mutual adjustment of the angle between the seat and the back rest may be sliding mechanisms, roller mechanisms with alternately provided rollers, with rollers on one or the other portion, since any possible counter loads may, e.g. be shaped as springs with, or without integrated locking mechanisms, e.g. gas springs. Those skilled in the art, however, may find other technical solutions of a mechanism based on the idea of the present invention.

Figure 4A:
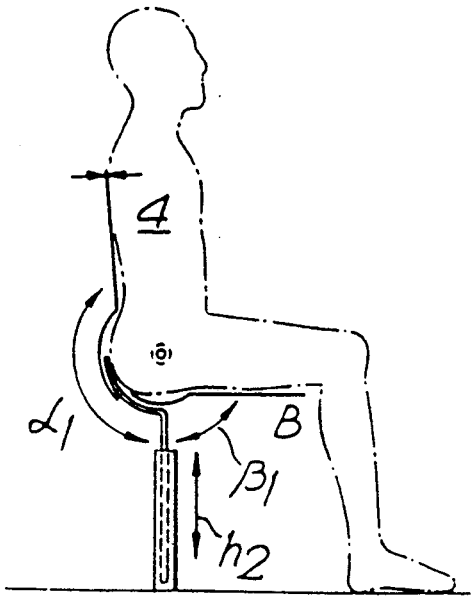
FIGS. 4A and 4B illustrate adjustment of the back rest of a chair according to the invention.
Figure 4B:
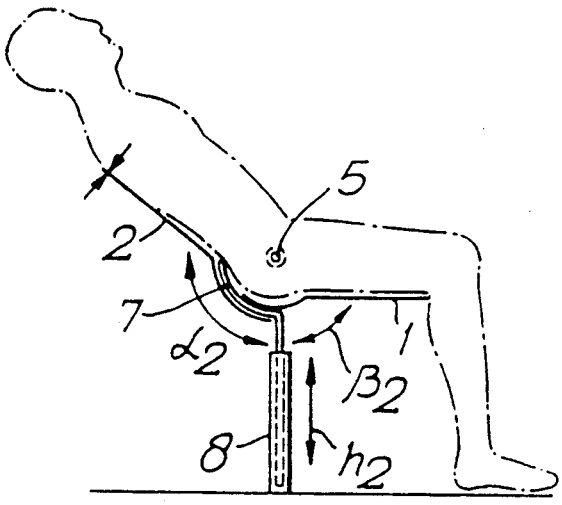
Figure 5A:
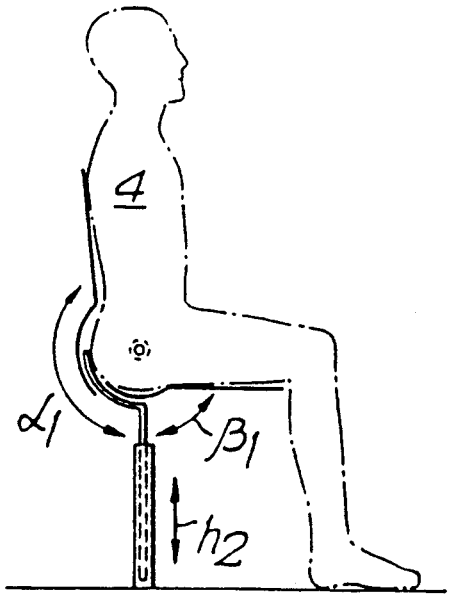
FIGS. 5A and 5B illustrate adjustment of the seat of a chair according to the invention.
Figure 5B:
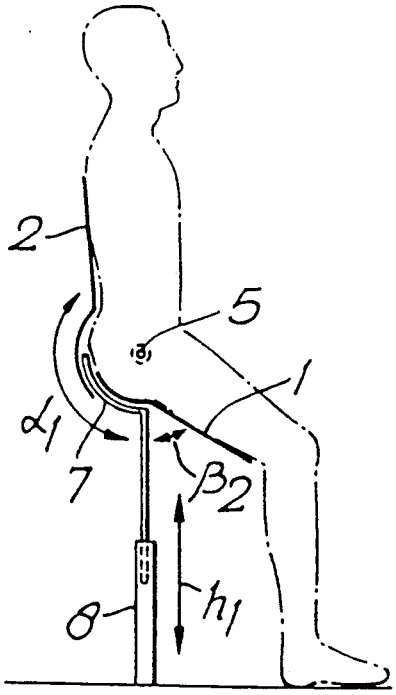

In FIG. 4 angle adjustment between the upper part of the body and the thighs is illustrated. The turning axis between seat 1 and back rest 2 coincides with the hip joint axis 5 of user 4. It will appear from FIG. 4 that the back rest 2 may be adjusted in an angle $\alpha_1$–$\alpha_2$. In similar manner the seat angle may be adjusted in a range of angles $b_1$–$b_2$, as shown in FIGS. 5*a* and 5*b*. As will appear from FIG. 5*b*, it will then be natural to adjust the level of the chair seat in a range $h_1$–$h_2$.

The mechanism for adjustment of the back rest and the mechanism for adjustment of the seat may be anchored to a common circular mounting plate 7 which is firmly mounted to mechanism 8 for adjustment of the chair level. Said mechanism for adjusting the level of a chair may, e.g. be a conventional gas lift device or another conventional mechanism for adjusting the level of the chair.

Mounting plate 7 is adjusted up and down (in the case of adjustment of the sitting level) by the aid of an activating handle (not shown) which is activated to release a locking mechanism (not shown) in connection with level adjusting means 8. By the aid of the same activation handle or a separate activation handle a locking mechanism (not shown) for circular movement between said mounting plate 7 and the seat plate 1 may be released. This activation handle may, if desired, be activated in e.g. two steps, the first step actuating seat adjustment and, if desired, mutual back rest adjustment, and the second step actuating level adjustment in addition to said first step.

As will appear from FIGS. 4 and 5, the lower portion of said back rest has an arcuate cross section, and the rear portion of the seat has a corresponding arcuate cross section with said portions being located o opposite sides of circle sector shaped mounting plate 7. In the shown embodiment the arcuate lower portion of the back rest has a slightly larger radius of curvature than that of said circular mounting plate 7, whereas the latter has a slightly larger radius of curvature than that of the rear arcuate portion of the seat.

Figure 6:
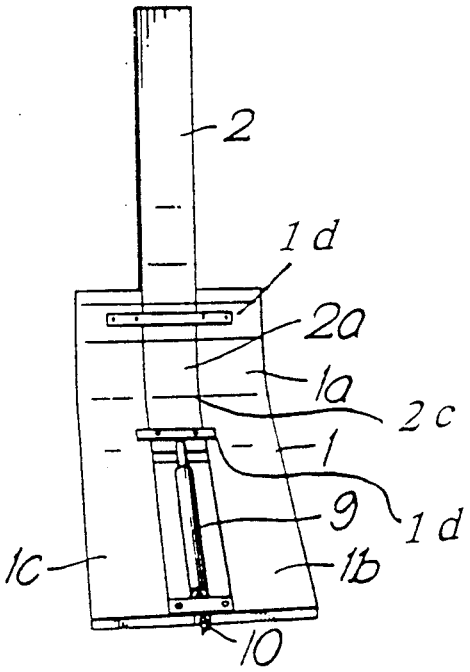
FIGS. 6, 7 and 8 illustrate a modification, diagrammatically shown, of the adjustment mechanism between seat and back rest.
Figure 7:
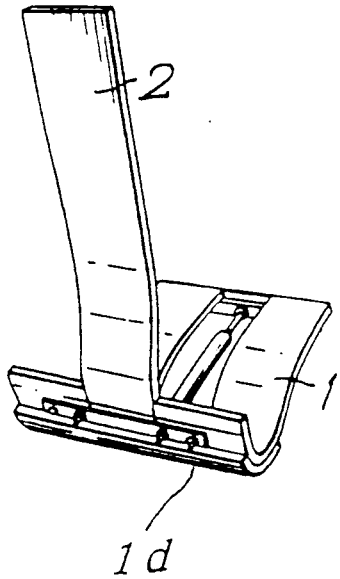
Figure 8:
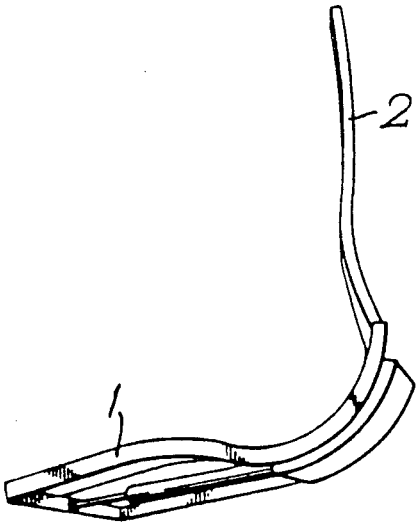

It will appear from FIGS. 6–8 how the back rest 2 is arcuate at its lower portion 2*a*, and how seat 1 is arcuate at its rear portion 1*a*. Said two portions are, in the shown embodiment, located in the same surface level. This is achieved by having the seat divided into two separate but connected members 1*b* and 1*c*, with the back rest 2 arranged between said seat members, as shown. The mutual angular position between seat and back rest is locked by the aid of a gas cylinder 9 or another mechanical locking device, and in case of movement between seat and back rest release button 10 is actuated. Gas cylinder 9 is located between the lower front portion 2*a* of the back rest and the front edge portion of the seat. Those skilled in the art will immediately understand that seat 1 and back rest 2 are shown without any padding, etc. in FIGS. 6–8.

In FIGS. 6–8 it is primarily assumed that the seat is fixed or tiltable in a conventional manner, whereas the back rest is adjustable in relation to the seat, as mentioned.

It should, however, be understood that if the back rest is essentially fixed, at least at its lower portion 2*a*, the arrangement of FIGS. 6–8 may be used for tilting the seat 1 relative to back rest 2.

Figure 9:
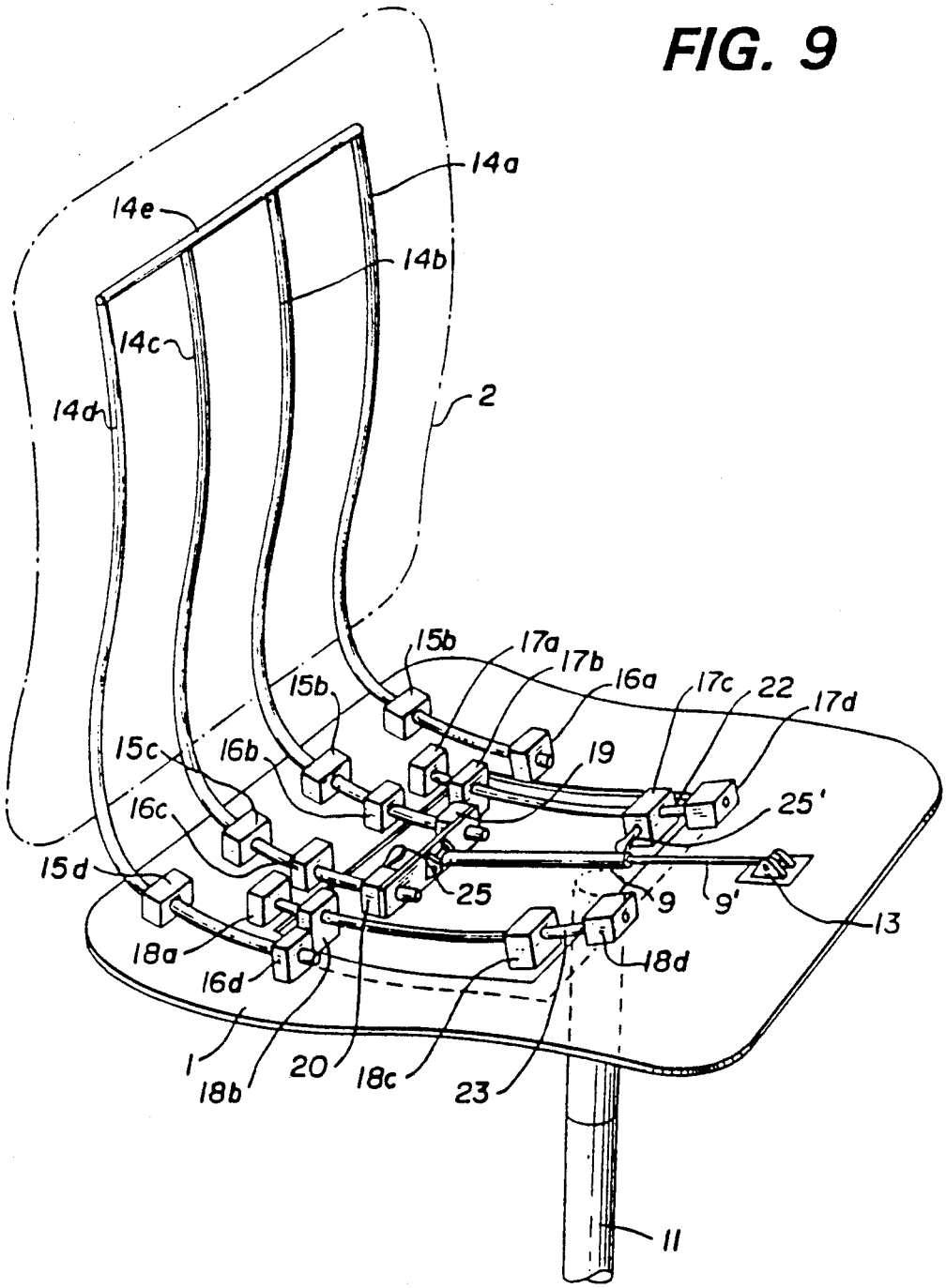
FIG. 9 illustrates a further, preferred embodiment of the chair.

In FIG. 9 is illustrated the presently best mode of the invention. Its way of operation is quite similar to that of FIGS. 6, 7 and 8.

There are four tubular means 14*a*, 14*b*, 14*c* and 14*d* which constitute the framework for the back rest 2. These members have at their respective upper ends been interconnected by an optional transverse means 14*e*. It is understood that the number of tubular means and their disposition is not limited to the value of four, but could be any number.

The tubes 14*a* and 14*d* have a curved lower ends that slidably engage slide shoes 15*a*, 16*a*, 15*d* and 16*d* secured to the seat 1. The back rest 2 has been outlined by means of dashed lines for sake of clarity. For the same reason, the seat 1 has been shown without upholstery, i.e. only with the seat subplate, for sake of simplicity.

Underneath the seat 1, there is located a support means 24, suitably in the form of a plate with brackets to interconnect with a conventional lifting mechanism, e.g. gas cylinder 11, on its bottom side and on its top side having slide shoes to slidably interconnect with the back rest and the seat as will be explained below.

The tubular means 14*b* and 14*c* interconnect with the seat through slide shoes 15*b*, 16*b*, 15*c* and 16*c*, respectively, said slide shoes being secured to said seat 1. Further, said tubular means 14*b* and 14*c* interconnect with the support 23 through slide shoes 19, 20, the slide shoes 19, 20 or only one of these being designed to cooperate with a locking means 25 to selectively clamp the tubular means 14*c* (in FIG. 9) to the slide shoe 20. It is noted that a bar 21 interconnects the ends of the tubular means 14*b*, 14*c*. Said locking means 25 could alternatively be so arranged as to selectively engage and hold the bar 21, in which case the slide shoes 19, 20 suitably could be deleted. As an even further alternative the slide shoe 17*c* in FIG. 10, could be provided with locking means 25', in which case the means 25 could be deleted.

The bar 21 forms an end mounting for the gas cylinder 9. The means to activate said cylinder is conventional and has not been indicated for sake of clarity in the drawing. The cylinder 9 has a piston rod 9' which is hinged at a bracket 13 to the front section of the seat 1.

Both the locking means 25 and the cylinder 9 are engageable from underneath the support 24.

Further, the seat 1 interconnects with the support 24 by means of slide shoes 17*b*, 17*c*, 18*b* and 18*c* which respectively engage curved tubular members 22 and 23, said members at their respective ends being secured to the seat by means of clamps 17*a*, 17*d*, and 18*a*, 18*d*, respectively.

Thus, when operating the chair, the locking means and gas cylinder are released. With the person sitting in the chair, leaning backwards and the seat remaining still, the length of the piston rod will decrease and the back rest 2 will assume a backward tilted position. With the back rest now in required position, the locking means 25 or 25' (as described above) can be operated. With the gas cylinder 9 still released or re-released, the seat may now be shifted to the required position, whereupon the gas cylinder 9 is inhibited to lock the seat and the back rest in a mutually desirable angle.

It is noted from FIG. 9 that the tubular means 14 and the members 22, 23 have essentially the same radius of curvature. In the shown embodiment of FIG. 9, they are of circular tubular cross section. However, they may have any suitable cross section, e.g. rectangular, and may be solid or tubular.

In FIG. 10 is illustrated in a schematic fashion how the support 24, the seat 1 and the back rest 2 are interrelated. The seat 1 and the back rest 2 have the same radius of curvature, as clearly appreciated from FIG. 9, but for illustrative reasons have been shown with a slightly different radius of curvature in FIG. 10.

In FIG. 11 the back rest is shown tilted 15° backwards, in FIG. 12 the chair is in its initial state with the back rest upright and the seat in normal "flat" position, and in FIG. 13 the chair is shown with the seat tilted 15° downwards.

It is readily appreciated that the slide shoes 15 *a–d* could be replaced by a single multi-holed slide shoe, and similarly for other sets of slide shoes.

It should be understood that the above disclosure and the enclosed drawings are only meant to illustrate the inventive idea without limiting the scope of the invention as defined in the following claims.

Also, the invention is obviously applicable to most kinds of chairs or body supporting means, e.g. office chairs, resting chairs, passenger chairs, patient chairs, beds, and all kinds of devices requiring adjustment of the angle between the upper part and the lower part of the human body.

What is claimed is:

1. An adjustable sitting device having a seat and a back rest, where said back rest is adjustable, said back rest having means for mutually turning about an imaginary axis, located above the seat and in front of the back rest, comprising a lower frame portion of the back rest in the form of a curved elongated planar back rest member located along a central longitudinal axis of the backrest and a rear frame portion of the seat in the form of two curved seat elongated planar members that each extend along longitudinal side edge portions of the seat and are separated by said back rest member, said back rest member and said curved elongated seat members each having the same approximate thickness, mutual adjustment means for permitting said back rest member to slide between facing edges of said two curved seat members whereby said back rest member moves about said imaginary axis as it moves between said two curved seat members, said back rest member and said pair of seat members being mutually slidable and wherein said lower frame portion of said back rest has the same radius of curvature as that of said rear frame portion.

2. An adjustable sitting device as defined in claim 1, wherein said mutual adjustment means comprises a controllable gas cylinder jack extending between a forward end of said back rest member and a forward edge of said seat and whereby said gas cylinder locks the mutual angular portion between the seat and the back.

3. The adjustable seating device in accordance with claim 1 wherein said back sliding means comprises spacer bars connected between said two curved elongated seat members and an edge guide means on said back rest member.

4. An adjustable seating device in accordance with claim 3 wherein said edge guide means comprises a pair of spacer bars, one on the top and the other on the bottom of said curved back rest and extending over said two curved elongated seat members on both edges of said curved back rest.

* * * * *